US006024311A

United States Patent [19]

Prairie et al.

[11] Patent Number: 6,024,311

[45] Date of Patent: Feb. 15, 2000

[54] ROTATING SHAFT SUPPORT ASSEMBLY FOR A BOWL MILL

[75] Inventors: Robert S. Prairie, Vernon; Gregory R. Strich, Enfield, both of Conn.

[73] Assignee: Combustion Engineering, Inc., Windsor, Conn.

[21] Appl. No.: 09/217,102

[22] Filed: Dec. 21, 1998

[51] Int. Cl.[7] ..... B02C 15/00

[52] U.S. Cl. ..... 241/117

[58] Field of Search ..... 241/117–121

[56] References Cited

U.S. PATENT DOCUMENTS 2,079,155 5/1937 Crites ..... 241/121

*Primary Examiner*—Mark Rosenbaum
*Attorney, Agent, or Firm*—Russell W. Warnock

[57] ABSTRACT

A pulverizer shaft rotation support assembly includes a rolling element sub-assembly for rotationally supporting the shaft of a pulverizer of a bowl mill of the type which is operative for pulverizing material such as coal into smaller particles, and includes a separator body having a bore, a rotating shaft supported within the bore, and a grinding table supported on the shaft. The rolling element sub-assembly includes an inner race secured to the shaft at a first shaft location, an outer race and a plurality of cylindrical bearings for rolling movement along and intermediate the inner and outer races. The pulverizer shaft rotational support assembly also includes an annular cutout in a gearbox housing structure for radially limiting the outer race while permitting axial movement thereof. The annular cutout limits the maximum radial displacement of the outer race to thereby maintain an annular clearance between the shaft and the bore while permitting axial following movement of the outer race in correspondence with axial movement of the inner race, whereby the shaft can freely rotate out of contact with the bore throughout the range of axial movement of the shaft during axial loading thereof.

17 Claims, 8 Drawing Sheets

ROTATING SHAFT SUPPORT ASSEMBLY FOR A BOWL MILL

BACKGROUND OF THE INVENTION

The present invention relates to a support assembly for a rotating shaft and, more particularly, to a support assembly for a rotating shaft on which is mounted the grinding table of a bowl mill operable to pulverize materials such as fossil fuel materials including coal.

It is known that a range of materials such as fossil fuels including, for example, coal, foodstuffs, and agricultural products, may be pulverized in a pulverizing operation performed by a bowl mill. A bowl mill, in one typical configuration, includes a separator body and a grinding table. The grinding table is supported on the top axial end of a shaft for rotation within the separator body. Such a bowl mill also includes a plurality of grinding rolls supported within the separator body, each grinding roll being operable to exert a grinding force on the material to be pulverized which is disposed on the grinding table for effecting the pulverization thereof.

During the grinding operation, a gear drive motor drivingly rotates the grinding table via a worm screw meshingly coupled with a driven gear fixedly coaxially mounted to the shaft. The grinding table cooperates with the grinding rolls to pulverize the material to be pulverized which, for illustrative purposes, will be considered to be coal. During this grinding process, the grinding table is subjected to radial and axial loading as coal particles of differing sizes and hardness are subjected to compressive action between the grinding rolls and the grinding table. Typically, the grinding rolls operate within a predetermined range of acceptable resistance force exerted on the grinding roll by the coal engaged between the grinding roll and the grinding table. If the acceptable resistance force is exceeded due to, for example, an encounter with a coal particle of relatively high hardness and of greater than a minimum size, then the is permitted to move out of grinding contact by, for example, overcoming the resilient bias of a spring biasing element acting on a journal supporting the grinding roll.

However, within the range of operation of the grinding rolls below those resistance forces which will cause a tripping out of a grinding roll, there is often an operating condition in which the grinding table is loaded in a manner which imposes radial forces on the shaft supporting the grinding table of the type which urge the shaft out of its axially centered—i.e., vertical-disposition. It can be appreciated, for example, that a loading may be transiently imposed on the grinding table at a radial spacing from the grinding table axis if a coal particle of a certain size and hardness is compressed between a grinding roll and the grinding table. Due to the fixed mounting of the grinding table on the top of the shaft, this offset radial loading is transmitted directly by the grinding table onto the shaft. It can also be appreciated that foreign matter such as tramp iron may be engaged between the grinding table and a grinding roll and this occurrence may cause offset radial loading of the grinding table and consequent radial displacement influences on the shaft.

Axial loading of the shaft is imposed by each compressive engagement of coal particles (or foreign matter) by the grinding table and the grinding rolls. Accordingly, it can be appreciated that the shaft is subjected, at some frequency, to simultaneous radial and axial loading and this operational reality presents a not insignificant challenge in providing effective and reliable rotational support of the shaft.

It has been proposed to provide a bowl mill with a combination of a thrust bearing arrangement and a bushing arrangement to handle the loading on the shaft supporting the grinding table and U.S. Pat. No. 2,079,155 to Crites is noted as representative of such a proposal. As disclosed in that patent, a bowl mill includes a shaft 19 supporting a bowl B and projecting freely downwardly through a sleeve 25. A hub 6 of the bowl B is journaled in a bearing sleeve or bushing 26 mounted in a bearing 5 which itself is mounted in a base plate 1 resting upon concrete pedestals. A lower end of a skirt 27 of the hub 6 is supported on an anti-friction thrust bearing 31. While the shaft rotational support arrangement disclosed in this patent may be adequate to handle the shaft loading situations outlined hereinbefore, it is still desirable to further optimize a shaft rotational support arrangement for a shaft of a bowl mill.

SUMMARY OF THE INVENTION

The present invention provides a pulverizer shaft rotational support assembly which effectively and reliably handles the radial and axial loading of the rotating shaft of a pulverizer on which is mounted the grinding table.

According to one aspect of the present invention, there is provided, for rotationally supporting the shaft of a pulverizer of a bowl mill, a pulverizer shaft rotation support assembly which includes a rolling element assembly. The bowl mill is of the type which is operative for pulverizing material such as coal into smaller particles and includes a separator body having a bore, a rotating shaft supported within the bore, a grinding table supported on the shaft for rotation within the separator body, and at least one grinding roll supported within the separator body so as to be operable to exert a grinding force on material disposed on the grinding table for effecting the pulverization thereof.

The pulverizer shaft rotational support assembly, in each variation of the one aspect of the present invention, includes at least one rolling element sub-assembly having an inner race secured to the shaft at a first shaft location, an outer race and at least one intermediate moving element retained relative to the inner and outer races for rolling movement of the intermediate moving element relative to the inner and outer races. The pulverizer shaft rotational support assembly also includes means for radially limiting the outer race while permitting relative axial movement between the outer race and the intermediate moving element, the radially limiting means limiting the maximum radial displacement of the outer race to thereby maintain an annular clearance between the shaft and the bore while permitting axial movement of the outer race and the intermediate moving element relative to one another in correspondence with axial movement of the inner race, whereby the shaft can freely rotate out of contact with the bore throughout the range of axial movement of the shaft during axial loading thereof.

According to one variation of the one aspect of pulverizer shaft rotational support of the present invention, there is provided a first and a second rolling element sub-assembly. The first rolling element sub-assembly includes an inner race secured to the shaft at a first shaft location, an outer race and at least one intermediate moving element retained relative to the inner and outer races for rolling movement of the intermediate moving element relative to the inner and outer races. Also, this one variation of the pulverizer shaft rotational support includes means for radially limiting the first outer race while permitting axial movement thereof, the radially limiting means limiting the maximum radial displacement of the first outer race to thereby maintain an annular clearance between the shaft and the bore while permitting axial following movement of the first outer race in correspondence with axial movement of the inner race, whereby the shaft can freely rotate out of contact with the bore at the first shaft location throughout the range of axial movement of the shaft during axial loading thereof.

Additionally, in the one variation of the one aspect of the pulverizer shaft rotational support assembly of the present invention, the second rolling element assembly including an inner race secured to the shaft at a second shaft location axially spaced from the first shaft location, an outer race and at least one intermediate moving element retained relative to the inner and outer races for rolling movement of the intermediate moving element relative to the inner and outer races. The pulverizer shaft rotational support assembly also includes means for radially limiting the second outer race while permitting relative axial movement between the second outer race and the intermediate moving element, the radially limiting means limiting the maximum radial displacement of the second outer race to thereby maintain an annular clearance between the shaft and the bore while permitting axial movement of the second outer race and the intermediate moving element relative to one another in correspondence with axial movement of the second inner race, whereby the shaft can freely rotate out of contact with the bore at the second shaft location throughout the range of axial movement of the shaft during axial loading thereof.

The one variation of the rotational support of the one aspect of the present invention is preferably provided with a first upper securement member secured to the shaft and a first lower securement member secured to the shaft, the inner race of the first rolling element sub-assembly being disposed axially intermediate the first upper securement member and the first lower securement member to be retained thereby at the first shaft location. Also, in accordance with one feature of this variation of the rotational support, the first upper securement member is a snap ring and the first lower securement member includes a lock nut and a lock washer.

According to a further feature of the one variation of the pulverizer shaft rotational support assembly of the one aspect of the present invention, there is further provided a second upper securement member secured to the shaft and a second lower securement member secured to the shaft, the second rolling element sub-assembly being disposed axially intermediate the second upper securement member and the second lower securement member and being retained thereby at the second shaft location.

In accordance with an additional feature of the one variation of the rotational support of the one aspect of the present invention, in the event that the pulverizer includes a gear secured to the shaft and a motive means for driving rotation of the shaft via the gear, the first shaft location at which is located the inner race of the first rolling element sub-assembly is axially preferably above the gear and the second shaft location at which is located the inner race of the second rolling element sub-assembly is axially below the gear. Moreover, the first shaft location is preferably located in the range of about 20% to 80% of the extent of the shaft extending below the gear as measured from the centerline of the gear to the bottom of the shaft and the second shaft location is preferably located in the range of about 20% to 80% of the extent of the shaft extending above the gear as measured from the centerline of the gear to the lowermost point of the surface of the grinding table.

In accordance with further additional features of the one variation of the one aspect of the present invention, the at least one intermediate moving element includes a plurality of intermediate moving elements. Also, a bushing assembly for supporting the shaft for axial movement relative thereto at a third shaft location axially spaced from the first and second shaft locations may be provided. Alternatively or in addition to the bushing assembly feature, there may be provided a thrust bearing assembly engageable by the shaft to transmit axial loading forces on the grinding table to the thrust bearing assembly.

According to still another feature of the one variation of the one aspect of the pulverizer shaft rotational support assembly of the present invention, a plane passing through a point of contact between the outer race of the first rolling element sub-assembly and the at least one intermediate moving element forms a ninety degree angle with the shaft axis or, alternatively, forms an angle more than ninety degrees. In accordance with another feature, the at least one intermediate moving element of the first rolling element sub-assembly is a bearing and is preferably a cylindrical bearing.

According to another variation of the one aspect of the pulverizer shaft rotational support assembly of the present invention, the rotational support includes a rolling element sub-assembly and a bushing assembly. The rolling element sub-assembly preferably includes an inner race secured to the shaft at a first shaft location, an outer race and at least one intermediate moving element retained relative to the inner and outer races for rolling movement of the intermediate moving element relative to the inner and outer races. In accordance with this another aspect of the pulverizer shaft rotational support assembly of the present invention, there is also provided a means forming an outer race receiving extent in which the outer race of the rolling element assembly is axially movably retained in rolling engagement with the at least one intermediate moving element such that the outer race is rotatable about the shaft axis while in rolling engagement with the at least one intermediate moving element of the rolling element assembly and the outer race is axially movable relative to the separator body. The bushing assembly supports the shaft for axial movement relative thereto at a second shaft location axially spaced from the first shaft location.

DETAILED DESCRIPTION OF THE PREFERRED EMBODIMENTS

Figure 1:
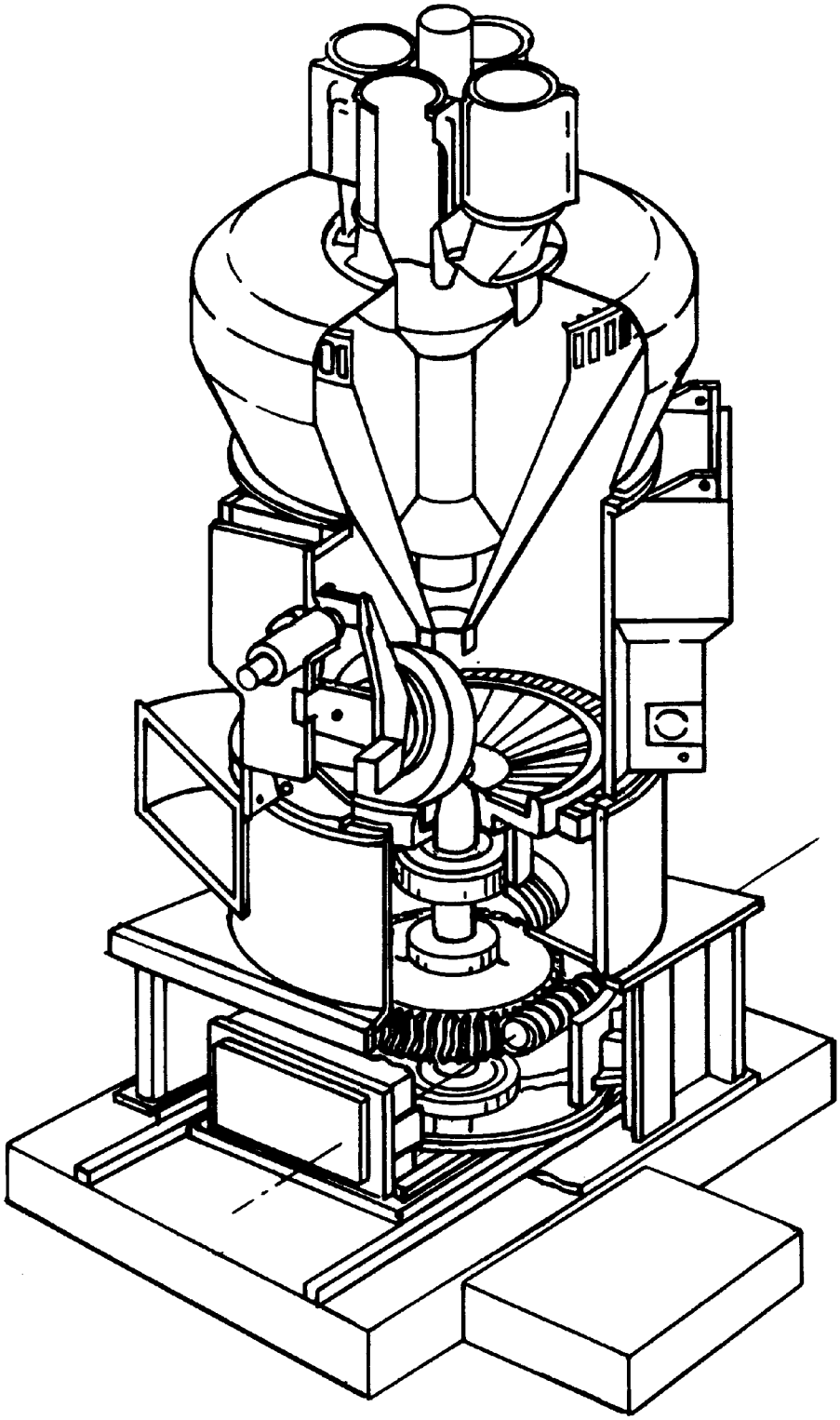
FIG. 1 is a perspective view in partial vertical section of a bowl mill having one embodiment of the pulverizer shaft rotational support assembly of the present invention and showing, in exploded perspective view, a pair of rolling element sub-assemblies of the pulverizer shaft rotational support assembly in partial vertical section.
Figure 1A:
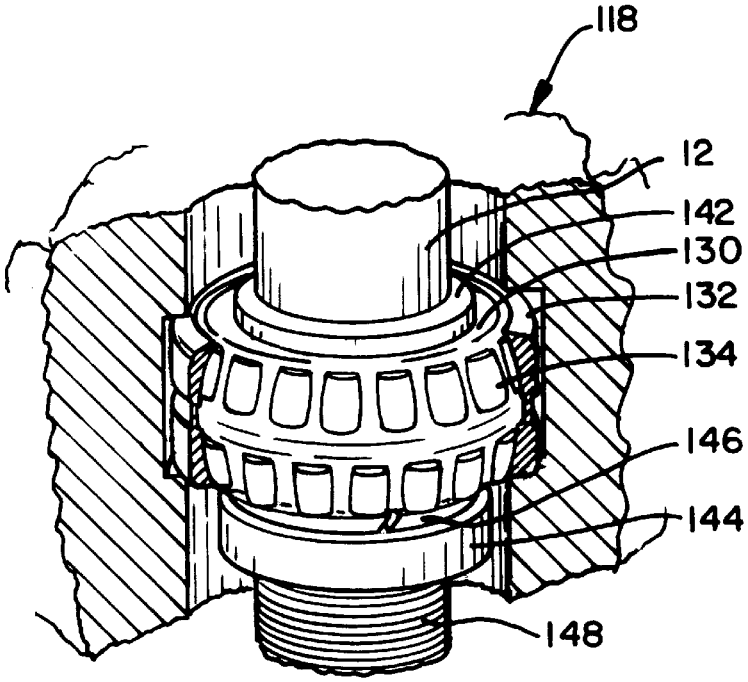
FIG. 1A is an enlarged perspective view of the upper rolling element sub-assembly of the pulverizer shaft rotational support assembly shown in FIG. 1.
Figure 1B:
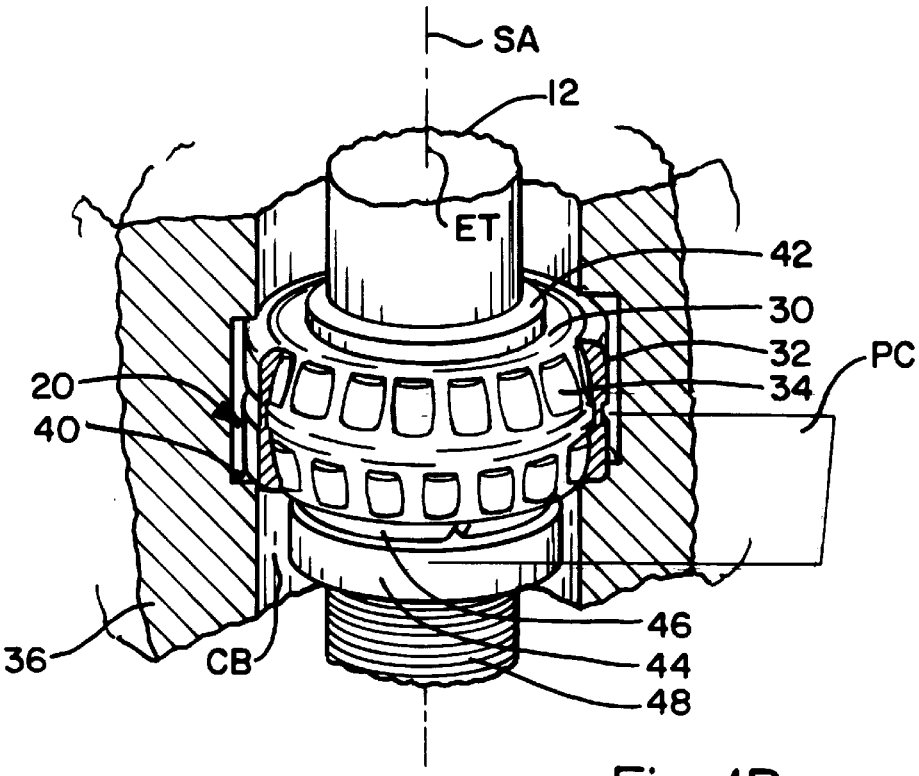
FIG. 1B is an enlarged perspective view of the lower rolling element sub-assembly of the pulverizer shaft rotational support assembly shown in FIG. 1.

In FIG. 1, one embodiment of the pulverizer shaft rotational support assembly of the present invention, generally designated as 10, is shown in rotationally supporting relationship with a shaft 12 of a pulverizer 14 of a bowl mill 16. The pulverizer shaft rotational support assembly 10 includes a rolling element sub-assembly 18 and a means 20 for radially limiting an outer race of the rolling element sub-assembly 18 while permitting axial movement thereof which together advantageously provide rotational support to the shaft 12 in a manner which will be described in more detail below. The bowl mill 16 is of the type which is operative for pulverizing a material such as, for example, coal 22, into smaller particles.

The bowl mill 16 includes a separator body 24 and a grinding table 26. The grinding table 26 is supported on the top axial end of the shaft 12 for rotation within the separator body 24. The bowl mill 16 also includes a plurality of grinding rolls 28 supported within the separator body 24, each grinding roll 28 being operable to exert a grinding force on the coal 22 disposed on the grinding table 26 for effecting the pulverization thereof.

With further reference now to FIG. 1, the rolling element sub-assembly 18 includes an inner race 30 secured to the shaft 12 at a first shaft location FL and an outer race 32. The rolling element sub-assembly 18 also includes at least one intermediate moving element which is preferably in the form of a plurality of cylindrical bearings 34 retained relative to the inner race 30 and the outer race 32 for rolling movement of the cylindrical bearings 34 relative to the inner and outer races. The rolling element sub-assembly 18 rotatably supports the shaft 12 for rotation relative to another structural portion of the bowl mill 16 which is, more specifically, a gearbox support frame 36 having a cylindrical through bore CB dimensioned to rotatably receive therein the shaft 12. The gearbox support frame 36 houses and supports as well a gear assembly 38 which is operatively connected to the grinding table 26 for driving rotation thereof, as will be described in more detail later.

As can be appreciated, the outer race 32 must be capable of unrestrained or free movement relative to the cylindrical bearings 34 in order for the rolling element sub-assembly 18 to function as a bearing of the rolling element type. Thus, as noted, the pulverizer shaft rotational support assembly 10 includes the means 20 for radially limiting an outer race of the rolling element sub-assembly 18 while permitting axial movement thereof which, in the one embodiment shown in FIG. 1, preferably includes a means forming an outer race receiving extent in which the outer race 32 is axially movably retained in rolling engagement with the cylindrical bearings 34 such that the outer race 32 is rotatable about the shaft axis SA while in rolling engagement with the cylindrical bearings 34. The means forming the outer race receiving extent is preferably in the form of an annular cutout 40 formed in the gearbox support frame 36.

The annular cutout 40 has an axial extent greater than the axial extent of the outer race 32, as measured relative to the shaft axis SA, and has a diameter greater than the outside diameter of the outer race 32. In turn, the diameter of the cylindrical through bore CB of the gearbox support frame 36 is less than the outer diameter of the outer race 32 (although the cylindrical through bore CB is of a greater diameter than the diameter of the shaft 12). Thus, the outer race 32 is axially movable relative to the separator body 24 (along the axial extent of the annular cutout 40) in a following movement in correspondence with axial movement of the inner race 30. Additionally, the outer race 32 is limited to a maximum radial displacement such that an annular clearance is maintained between the shaft 12 and the cylindrical through bore CB. Accordingly, it can be seen than the annular cutout 40 limits the maximum radial displacement of the outer race 32 to thereby maintain an annular clearance between the shaft 12 and the cylindrical through bore CB while permitting axial following movement of the inner race 30, whereby the shaft 12 can freely rotate out of contact with the cylindrical through bore CB throughout the range of axial movement of the shaft 12 during axial loading thereof.

With further attention now to the details of the rolling element sub-assembly 18, the cylindrical bearings 34 are each individually rotatably supported on the outer circumference of the inner race 30 such that each cylindrical bearing 34 is rotatable about its individual axis parallel to the shaft axis SA. Alternatively, although not illustrated, spherical bearings may be used in lieu of the cylindrical bearings 34, in which event each spherical bearing would undergo individual rotation as the bearing undergoes translational movement along the circumferential path formed between the inner race 30 and the outer race 32. The cylindrical bearings 34 are distributed at uniform circumferential spacings from one another about the outer circumferential surface of the inner race 30.

The radially outermost points of rotational travel of the cylindrical bearings 34 collectively define an imaginary circumference having a radius greater than the radius of the outer circumference of the inner race 30 such that the outer race 32 is not in direct contact with the inner race 30. The inner annular circumferential surface of the outer race 32 is of a radius sized correspondingly to the imaginary circumference formed by the cylindrical bearings 34 such that the inner circumferential surface of the outer race 32 is in continuous rolling contact with the cylindrical bearings 34.

Thus, the outer race 32 rolls or rotates about the shaft axis SA relative to the inner race 30 in continuous rolling engagement with the plurality of cylindrical bearings 34.

The inner race 30 is preferably fixedly secured to the shaft 12 at the first shaft location FL. The inner race 30 may be secured to the shaft 12 by any suitable securement means such as a press fit or a threaded fit; however, the inner race 30 is preferably secured to the shaft 12 by the cooperative mounting arrangement of a first upper securement member in the form of a snap ring 42 which compressively grips the shaft 12 and a first lower securement member including a lock nut 44 and a lock washer 46. The lock nut 44 is threadably secured to the shaft 12 on threads 48 provided thereon and the lock nut 44 is threadably movable along the shaft 12 in the axial direction toward the snap ring 42 in an adjustable manner such that the inner race 30 is compressively engaged, at its top axial end, by the snap ring 42 and, at its bottom axial end, by the lock washer 46 so as to be fixedly axially mounted to the shaft 12 at the first shaft location FL.

The one embodiment of the pulverizer shaft rotational support 10 illustrated in FIG. 1 also includes a second rolling element sub-assembly 118 having an inner race 130 secured to the shaft 12 at a second shaft location SL and an outer race 132. The rolling element sub-assembly 118 also includes at least one intermediate moving element which is preferably in the form of a plurality of cylindrical bearings 134 retained relative to the inner race 130 and the outer race 132 for rolling movement of the cylindrical bearings 134 relative to the inner and outer races. The rolling element sub-assembly 118 rotatably supports the shaft 12 for rotation relative to the gearbox support frame 36 at a location axial above the first shaft location FL.

The inner race 130 is preferably fixedly secured to the shaft 12 at the second shaft location SL. The inner race 130 may be secured to the shaft 12 by any suitable securement means such as a press fit or a threaded fit; however, the inner race 130 is preferably secured to the shaft 12 by the cooperative mounting arrangement of a second upper securement member in the form of a snap ring 142 which compressively grips the shaft 12 and a second lower securement member including a lock nut 144 and a lock washer 146. The lock nut 144 is threadably secured to the shaft 12 on threads 148 provided thereon and the lock nut 144 is threadably movable along the shaft 12 in the axial direction toward the snap ring 142 in an adjustable manner such that the inner race 130 is compressively engaged, at its top axial end, by the snap ring 142 and, at its bottom axial end, by the lock washer 146 so as to be fixedly axially mounted to the shaft 12 at the second shaft location SL. As seen in FIG. 1, a plane PC passing through a point of contact between the inner race 30 of the rolling element sub-assembly 18 (or the inner race 130 of the rolling element sub-assembly 118) and one of the cylindrical bearings 34 (or the cylindrical bearings 134 of the rolling element sub-assembly 118) and a point of contact between the outer race 32 (or the outer race 134) and the respective cylindrical bearing forms a 90 degree angle with the shaft axis SA.

With further reference now to the selection of the first shaft location FL and the second shaft location SL, these shaft locations may be designated with respect to any suitable arbitrary reference location. For example, the shaft locations may be designate with respect to the gear assembly 38 which includes a gear housing 50 in which a driven gear 52 is fixedly mounted to the shaft 12 at a location axially intermediate the first shaft location FL and the second shaft location SL. The driven gear 52 may be axially fixedly secured to the shaft 12 any appropriate securement means sufficient to couple the driven gear to the shaft for rotation therewith and, preferably, in a manner in which the driven gear and the securement means are spaced from the pulverizer shaft rotational support assembly 10 including its first rolling element sub-assembly 18 and its second rolling element sub-assembly 118. For example, as seen in FIG. 1, the driven gear 52 is fixedly secured to the shaft 12 for rotation therewith by a shaft coupling device SCD which is a conventional device of the type which is disposed in press fit relationship radially intermediate a relatively smaller diameter rotating element (i.e., the shaft 12) and another element of relatively larger diameter (i.e., the driven gear 52). It can be seen that the shaft coupling device SCD is axially spaced from the first rolling element sub-assembly 18 and the second rolling element sub-assembly 118.

The driven gear 52 is threadably coupled to a worm drive shaft 54 of a motor 56. The motor 56 is operable to drivingly rotate the grinding table 26 via the worm drive shaft 54 and the driven gear 52. The vertical axis of the driven gear 52 is the shaft axis SA and a horizontal axis or centerline GCL of the driven gear extends perpendicularly to the vertical axis through the plane of rotation of the gear. The first shaft location FL is preferably located in the range of about 20% to 80% of the axial extent of the shaft 12 extending below the gear 52 as measured from the centerline GCL of the gear 52 to the bottom of the shaft 12. The second shaft location SL is preferably located in the range of about 20% to 80% of the extent of the shaft 12 extending above the gear 52 as measured from the centerline GCL of the gear 52 to the axially lowermost point on the surface of the grinding table 26.

In some operational circumstances, it may be desirable to minimize or prevent rotation of the outer race 532 of the rolling element sub-assembly 518A and this can be achieved, for example, by providing a dowel 570 or other insert type pin which is seated in a seat 572 in the gearbox support frame 36 and in a race seat 574 in the outer race 532.

In the one embodiment of the pulverizer shaft rotational support assembly 10 shown in FIG. 1, the pair of rolling element sub-assemblies 18, 118 are designed to assist in supporting the shaft 12 within the cylindrical bore CB of the gearbox support frame 36 with respect to radial loading of the shaft as transmitted thereto by the grinding action on the grinding table 26. However, the grinding table 26 is additionally subjected to thrust or axial loading and, to support this thrust or axial loading (which is transmitted by the grinding table 26 to the shaft 12), a thrust bearing assembly 58 is provided which is a conventional thrust bearing assembly having a shaft engaging portion which engages the shaft 12 for the transmission of thrust loading to the thrust bearing assembly and a frame portion for transmitting the received thrust loading forces to the separator body 24.

The operation of the rolling element sub-assembly 18 will now be described, it being understood that the rolling element assembly 118 operates in like manner to provide rotational support to the shaft 12. During the grinding operation, the motor 56 drivingly rotates the grinding table 26 which cooperates with the grinding rolls 28 to pulverize the coal 22. During this grinding process, the grinding table 26 is subjected to radial and axial loading as the coal particles 22 of differing sizes and hardness are subjected to compressive action between the grinding rolls 28 and the grinding table 26 and, additionally, as foreign matter such as tramp iron is engaged between the grinding table 26 and the grinding rolls 28. This axial and radial loading of the grinding table 26 is transmitted directly to the shaft 12. Thus, the shaft 12 is urged, in response to the radial loading of the grinding table 26, to move radially within the cylindrical bore CB of the gearbox support frame 36. Additionally, the shaft 12 is urged, under the action of the axial or thrust loading of the grinding table 26, to move axially relative to the gearbox support frame 36.

The rolling element sub-assembly 18 handles the radial loading of the shaft 12 in a manner which permits the shaft 12 to rotate in a contact-free manner with respect to the cylindrical bore CB of the gearbox frame support 36. During rotation of the shaft 12, the inner race 30, which is fixedly mounted to the shaft, rotates with the shaft while, in contrast, the outer race 32, which is not fixedly mounted to the shaft, does not rotate in strict correspondence with the rotation of the shaft. The inner circumferential surface of the outer race 32 is rollingly engaged by each of the plurality of the cylindrical bearings 34 as these cylindrical bearings are moved along with the inner race 30. Additionally, each of the cylindrical bearings 34 rotates about its individual axis to provide an optimally minimized friction engagement between the non-rotating outer race 32 and the shaft 12. The outer circumferential surface of the outer race 32 is engaged by the axial surface of the annular cutout 40 such that the outer race 32 is maintained in a shaft-centering disposition in which it retains the shaft 12 in a generally radially centered orientation within the cylindrical bore CB of the gearbox frame support 36.

Moreover, the rolling element sub-assembly 18 provides this rotational support of the shaft 12 in a manner which is not influenced or degraded by the thrust or axial loading of the shaft 12 which occurs, or may occur, at the same time that the shaft is being radially loaded. Specifically, the annular cutout 40, which, as noted, has an axial extent greater than the outer race 32, operates to accommodate axial movement of the outer race 32 relative to the gearbox frame support 36 while supporting the outer race to maintain the shaft 12 in its contact-free rotation relative to the gearbox frame support 36. During axial loading of the shaft 12 sufficient to cause axial movement of the shaft, the outer race 32 moves within the annular cutout 40 relative to the gearbox frame support 36.

Figure 2:
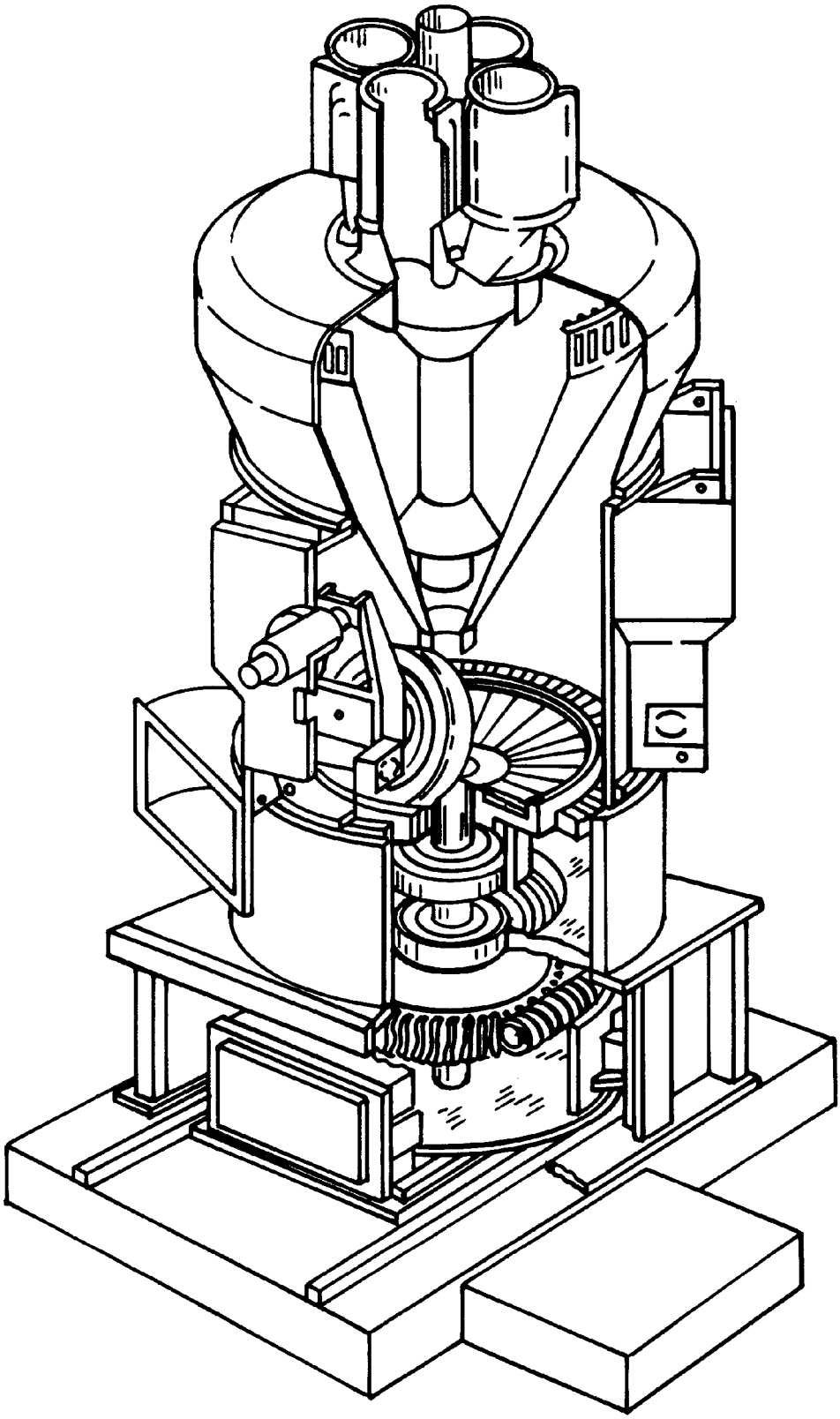
FIG. 2 is a perspective view in partial vertical section of a bowl mill having another embodiment of the pulverizer shaft rotational support assembly of the present invention and showing, in exploded perspective view, a rolling element sub-assembly and a bushing assembly of the pulverizer shaft rotational support assembly.
Figure 2A:
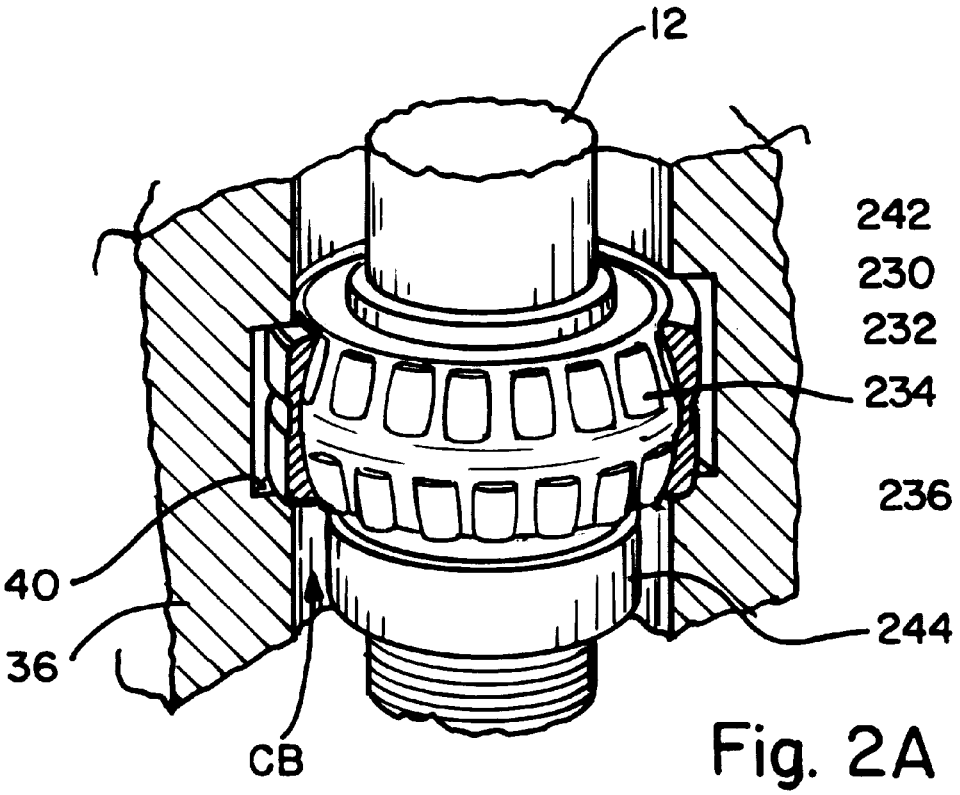
FIG. 2A is an enlarged perspective view of the upper rolling element sub-assembly of the pulverizer shaft rotational support assembly shown in FIG. 2.
Figure 2B:
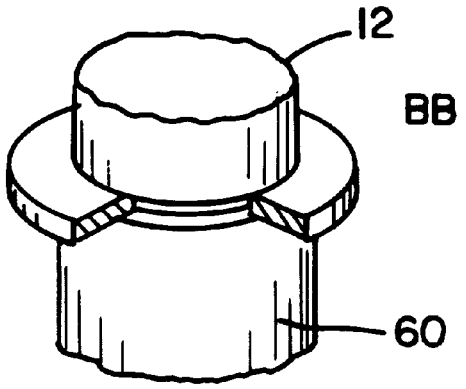
FIG. 2B is an enlarged perspective view of the bushing sub-assembly of the pulverizer shaft rotational support assembly shown in FIG. 2.

As seen in FIG. 2, another embodiment of the pulverizer shaft rotational support of the present invention is illustrated and is generally designated as 210. The pulverizer shaft rotational support assembly 210 includes a bushing assembly 60 disposed at the first shaft location FL and a rolling element sub-assembly 218 disposed at the second shaft location SL. The bushing assembly 60 is mounted to the gearbox frame support 36 in a manner in which the bushing assembly is axially secure. The bushing assembly 60 includes a cylindrical through bore BB for receiving therethrough a portion of the shaft 12 such that the shaft 12 may rotate relative to the bushing assembly.

The second rolling element sub-assembly 218 includes an inner race 230 secured to the shaft 12 at the second shaft location SL and an outer race 232. The rolling element sub-assembly 218 also includes at least one intermediate moving element which is preferably in the form of a plurality of cylindrical bearings 234 retained relative to the inner race 230 and the outer race 232 for rolling movement of the cylindrical bearings 234 relative to the inner and outer races. The rolling element sub-assembly 118 rotatably supports the shaft 12 for rotation relative to the gearbox support frame 36 at a location axial above the first shaft location FL.

The inner race 230 is preferably fixedly secured to the shaft 12 at the second shaft location SL. The inner race 230 may be secured to the shaft 12 by any suitable securement means such as a press fit or a threaded fit; however, the inner race 230 is preferably secured to the shaft 12 by the cooperative mounting arrangement of an upper securement member in the form of a snap ring 242 which compressively grips the shaft 12 and a lower securement member including a lock nut 244 and a lock washer 246. The lock nut 244 is threadably secured to the shaft 12 on threads 248 provided thereon and the lock nut 244 is threadably movable along the shaft 12 in the axial direction toward the snap ring 242 in an adjustable manner such that the inner race 230 is compressively engaged, at its top axial end, by the snap ring 242 and, at its bottom axial end, by the lock washer 246 so as to be fixedly axially mounted to the shaft 12 at the second shaft location SL.

The pulverizer shaft rotational support assembly 210 also includes a means 220 for radially limiting an outer race of the rolling element sub-assembly 218 while permitting axial movement thereof which preferably includes a means forming an outer race receiving extent in which the outer race 232 is axially movably retained in rolling engagement with the cylindrical bearings 234 such that the outer race 232 is rotatable about the shaft axis SA while in rolling engagement with the cylindrical bearings 234. The means forming the outer race receiving extent is preferably in the form of an annular cutout 40 formed in the gearbox support frame 36.

The annular cutout 40 has an axial extent greater than the axial extent of the outer race 232, as measured relative to the shaft axis SA, and has a diameter greater than the outside diameter of the outer race 232. In turn, the diameter of the cylindrical through bore CB of the gearbox support frame 36 is less than the outer diameter of the outer race 232 (although the cylindrical through bore CB is of a greater diameter than the diameter of the shaft 12). Thus, the outer race 232 is axially movable relative to the separator body 24 (along the axial extent of the annular cutout 40) in a following movement in correspondence with axial movement of the inner race 230. Additionally, the outer race 232 is limited to a maximum radial displacement such that an annular clearance is maintained between the shaft 12 and the cylindrical through bore CB. Accordingly, it can be seen that the annular cutout 40 limits the maximum radial displacement of the outer race 232 to thereby maintain an annular clearance between the shaft 12 and the cylindrical through bore CB while permitting axial following movement of the inner race 230, whereby the shaft 12 can freely rotate out of contact with the gearbox support frame 36.

The rolling element sub-assembly 218 and the bushing assembly 60 together handle the axial and radial loading of the shaft 12 during the grinding process. The bushing assembly 60, which may be comprised of brass material, permits relative rotation of the shaft 12 while also permitting relative axial movement of the shaft. The rolling element sub-assembly 218 assists in the rotational support of the shaft 12 and is particularly designed to accommodate the radial loading of the shaft in the manner described in connection with the rolling element sub-assemblies 18, 118 of the one embodiment of the pulverizer shaft rotational support assembly 10 illustrated in FIG. 1.

Thus, the pulverizer shaft rotational support assembly 210 includes a rolling element sub-assembly 218 and a bushing assembly 60. There is also provided a means forming an outer race receiving extent in which the outer race 232 of the rolling element sub-assembly 218 is axially movably retained in rolling engagement with the at least one intermediate moving element such that the outer race 232 is rotatable about the shaft axis SA while in rolling engagement with the at least one intermediate moving element of the rolling element sub-assembly 218 and the outer race 232 is axially movable relative to the separator body 24. The bushing assembly 60 supports the shaft 12 for axial movement relative thereto at the first shaft location FL axially spaced from the second shaft location SL.

Figure 3:
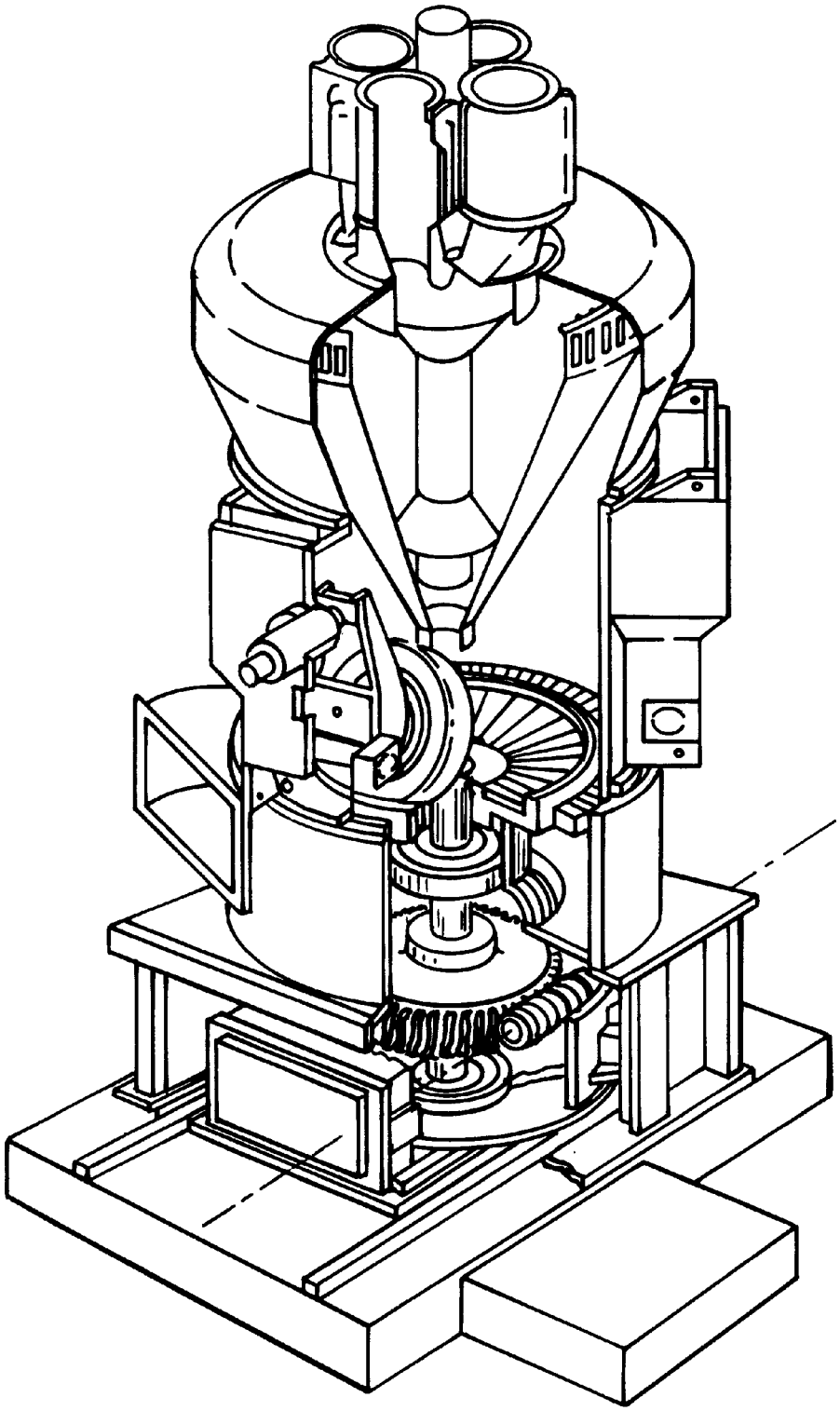
FIG. 3 is a perspective view in partial vertical section of a bowl mill having a further embodiment of the pulverizer shaft rotational support assembly of the present invention and showing, in exploded perspective view, a pair of rolling element sub-assemblies of the pulverizer shaft rotational support assembly in partial vertical section.
Figure 3A:
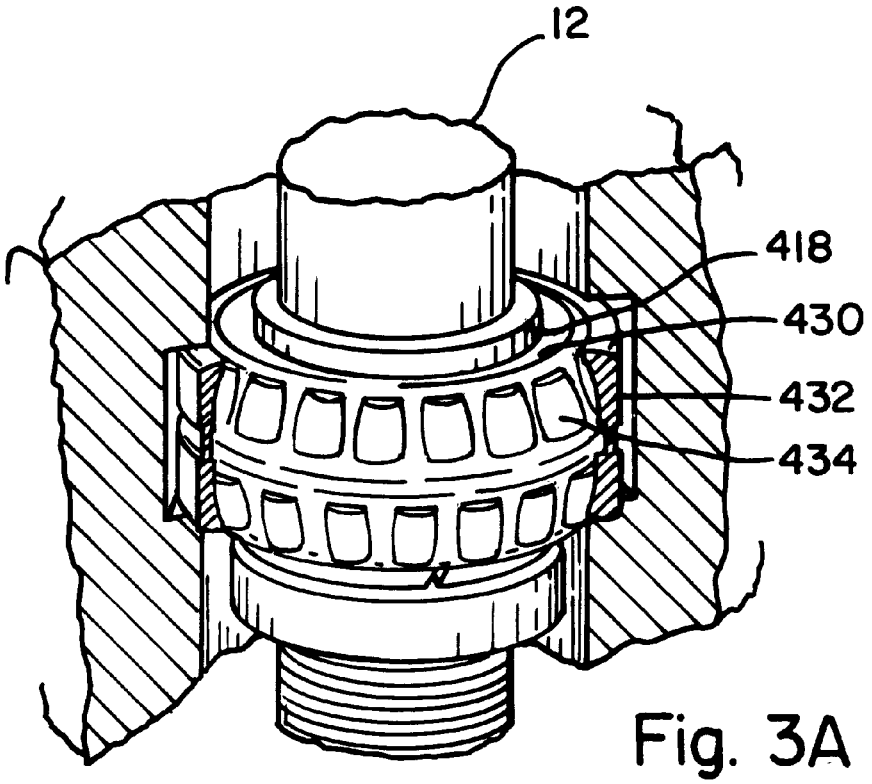
FIG. 3A is an enlarged perspective view of the upper rolling element sub-assembly of the pulverizer shaft rotational support assembly shown in FIG. 3.
Figure 3B:
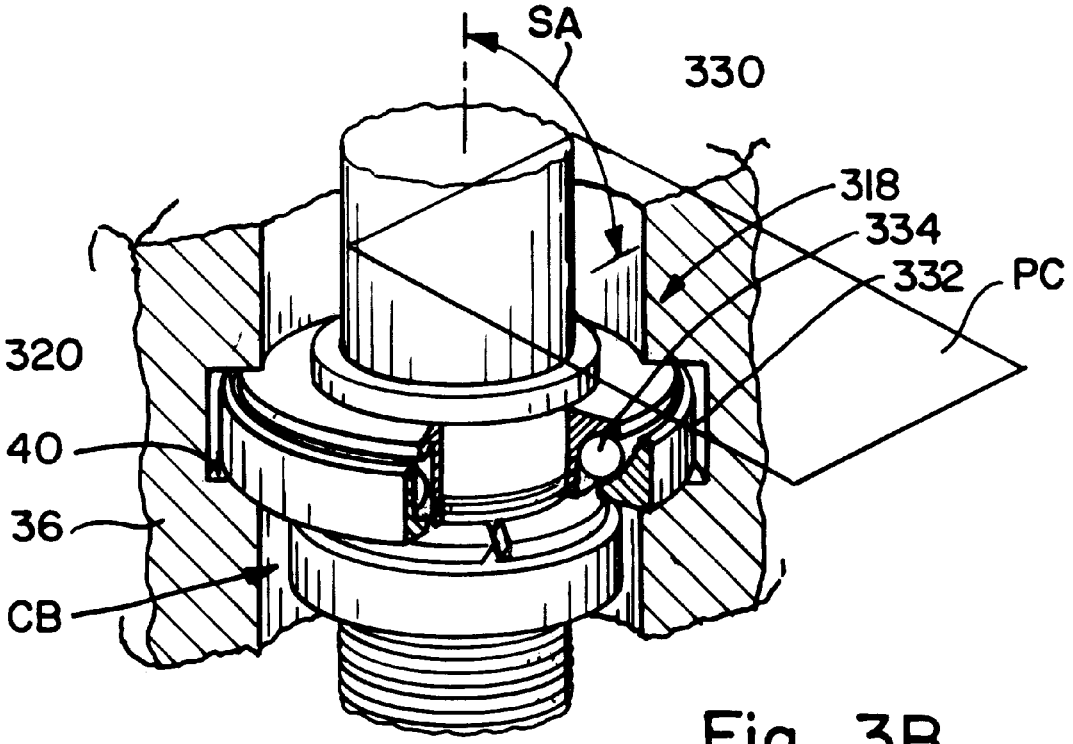
FIG. 3B is an enlarged perspective view of the upper rolling element sub-assembly of the pulverizer shaft rotational support assembly shown in FIG. 3.

In FIGS. 3, 3A, and 3B, a further embodiment of the pulverizer shaft rotational support assembly of the present invention is illustrated and is generally designated as 310. The pulverizer shaft rotational support assembly 310 includes a pair of rolling element sub-assemblies 318 and 418 and a pair of means 320 for radially limiting an outer race of each respective rolling element sub-assembly 318 and 418 while permitting axial movement thereof.

The rolling element sub-assembly 318, shown in more detail in FIG. 3B, includes an inner race 330 secured to the shaft 12 at a first shaft location FL and an outer race 332. The rolling element sub-assembly 318 also includes at least one intermediate moving element which is preferably in the form of a plurality of cylindrical bearings 334 retained relative to the inner race 330 and the outer race 332 for rolling movement of the cylindrical bearings 334 relative to the inner and outer races. The rolling element sub-assembly 318 rotatably supports the shaft 12 for rotation relative to the gearbox support frame 36.

With further attention now to the details of the rolling element sub-assembly 318, the cylindrical bearings 334 are each in the form of a sphere and are each individually rotatably supported between the outer circumference of the inner race 330 and the inner circumference of the outer race 332 such that each cylindrical bearing 334 is rotatable about its individual axis parallel to the shaft axis SA. The cylindrical bearings 334 are distributed at uniform circumferential spacings from one another about the outer circumferential surface of the inner race 330. The outer circumferential surface of the inner race 330 and the inner annular circumferential surface of the outer race 332 are each comprised of an upper annular axial portion and a canted lower axial portion. The cylindrical bearings 334 are rotatably supported between the canted lower axial portions of the outer circumferential surface of the inner race 330 and the inner annular circumferential surface of the outer race 332. Accordingly, as seen in FIG. 3B, a plane PC passing through a point of contact between the inner race 330 of the rolling element sub-assembly 318 and one of the cylindrical bearings 334 and a point of contact between the outer race 332 and the respective cylindrical bearing 334 forms a greater than ninety (90) degree angle ET with the shaft axis SA—i.e., an obtuse angle.

The second rolling element sub-assembly 418 of the further embodiment of the pulverizer shaft rotational support 310 is shown in more detail in FIG. 3A and includes an inner race 430 secured to the shaft 12 at a second shaft location SL and an outer race 432. The rolling element sub-assembly 418 also includes at least one intermediate moving element which is preferably in the form of a plurality of cylindrical bearings 434 retained relative to the inner race 430 and the outer race 432 for rolling movement of the cylindrical bearings 434 relative to the inner and outer races. Each cylindrical bearing 434 (only one of which is representatively shown in FIG. 3A) is in the form of a cylinder and is rotatably supported between the inner race 430 and the outer race 432 for rotation about its longitudinal axis parallel to the axis of the shaft 12. The outer race 432 is preferably in the form of an annular ring having a rectangular cross section while the inner race 430 is preferably in the form of an annular member having a pair of radially outwardly projecting flanges at each axial end thereof for axially retaining the cylindrical bearings 434 therebetween. This arrangement of the inner race 430, the outer race 432, and the cylindrical bearings 434 permits the cylindrical bearings 434 to move axially relative to the outer race 432 while the outer race 432, which is retained in the annular cutout 40, is thereby limited in its radial movement.

The rolling element sub-assembly 418 rotatably supports the shaft 12 for rotation relative to the gearbox support frame 36 at a location axial above the first shaft location FL. A plane passing through a point of contact between the inner race 430 of the rolling element sub-assembly 418 and one of the cylindrical bearings 434 and a point of contact between the outer race 432 and the respective bearing 434 forms a ninety (90) degree angle ET with the shaft axis SA.

The pulverizer shaft rotational support assembly 310 handles the radial and axial loading of the shaft 12 in a manner which permits the shaft 12 to rotate in a contact-free manner with respect to the cylindrical bore CB of the gearbox frame support 36. During rotation of the shaft 12, the inner race 330 of the rolling element sub-assembly 318, which is fixedly mounted to the shaft, rotates with the shaft while, in contrast, the outer race 332, which is not fixedly mounted to the shaft, does not rotate in correspondence with the rotation of the shaft. The canted lower axial portion of the inner circumferential surface of the outer race 332 is rollingly engaged by each of the plurality of the cylindrical bearings 334 as these cylindrical bearings are moved along with the inner race 330 and the radial and axial loading of the shaft 12 is thereby transmitted via the inner race 330 to the outer race 332. The outer circumferential surface of the outer race 332 is engaged by the axial surface of the annular cutout 40 such that the outer race 332 is maintained in a shaft-centering disposition in which it retains the shaft 12 in a generally radially centered orientation within the cylindrical bore CB of the gearbox frame support 36.

Also, during rotation of the shaft 12, the inner race 430 of the rolling element sub-assembly 418, which is fixedly mounted to the shaft, rotates with the shaft while, in contrast, the outer race 432, which is not fixedly mounted to the shaft, does not rotate in correspondence with the rotation of the shaft. The inner circumferential surface of the outer race 432 is rollingly engaged by each of the plurality of the cylindrical bearings 434 as these cylindrical bearings are moved along with the inner race 430 and the radial loading of the shaft 12 is thereby transmitted via the inner race 430 to the outer race 432. The outer circumferential surface of the outer race 432 is engaged by the axial surface of the annular cutout 40 such that the outer race 432 is maintained in a shaft-centering disposition in which it retains the shaft 12 in a generally radially centered orientation within the cylindrical bore CB of the gearbox frame support 36.

Figure 4:
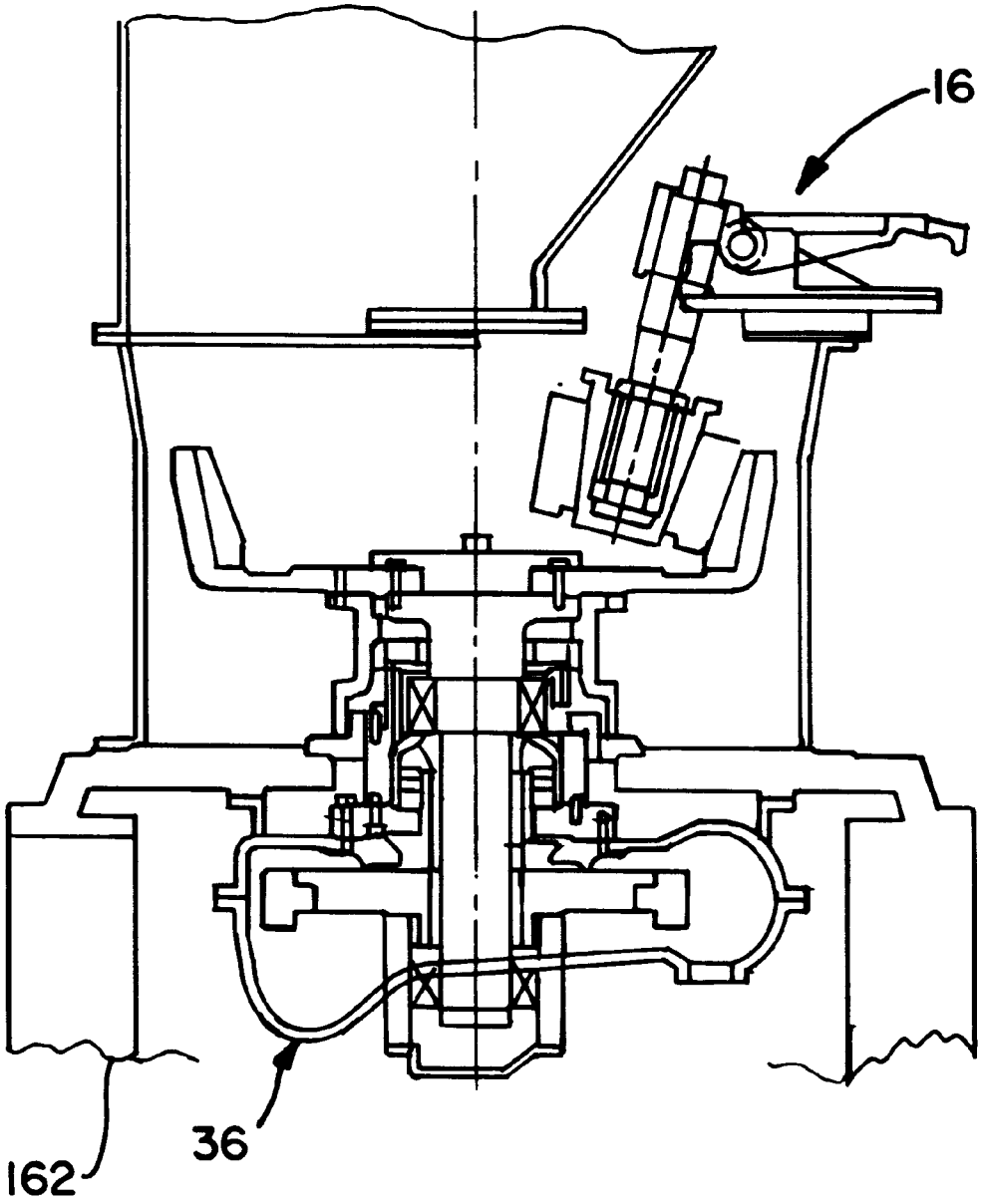
FIG. 4 is a front elevational view in partial vertical section of a bowl mill of the type having a hanging gear box and a variation of any of the embodiments of the pulverizer shaft rotational support assembly of the present invention and showing, in exploded perspective view, a pair of rolling element sub-assemblies of the pulverizer shaft rotational support assembly and a bushing assembly in partial vertical section.
Figure 4A:
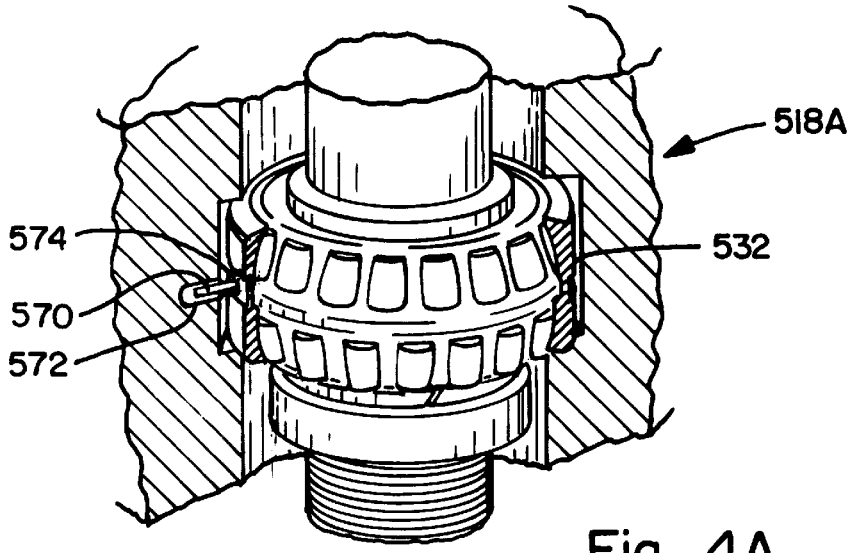
FIG. 4A is an enlarged perspective view of the upper rolling element sub-assembly of the pulverizer shaft rotational support assembly shown in FIG. 4.
Figure 4B:
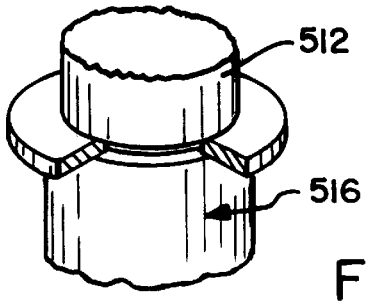
FIG. 4B is an enlarged perspective view of the bushing sub-assembly of the pulverizer shaft rotational support assembly shown in FIG. 4.
Figure 4C:
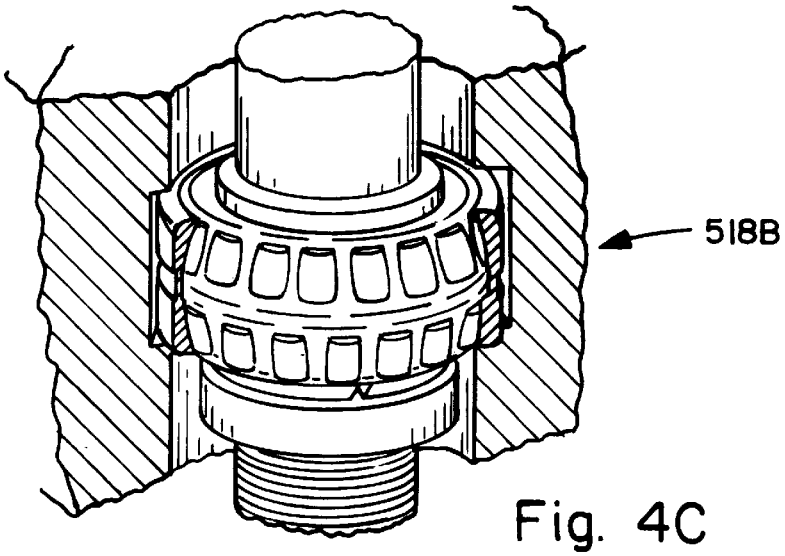
FIG. 4C is an enlarged perspective view of the lower rolling element sub-assembly of the pulverizer shaft rotational support assembly shown in FIG. 4.

In FIG. 4, a variation of the pulverizer shaft rotational support assembly is illustrated which may include any selected combination of the respective rolling element sub-assembly or sub-assemblies and the bushing sub-assembly described with respect to the embodiments illustrated in FIGS. 1–3 for rotationally supporting the shaft 12 at the first shaft location FL and the second shaft location SL and which additionally includes a bushing assembly 160 for supporting the shaft for axial movement relative thereto at a third shaft location axially spaced from the first shaft location FL and the second shaft location SL. In the exemplary configuration of the pulverizer shaft rotational support assembly shown in FIG. 4, the assembly includes a pair of rolling element sub-assemblies 518A and 518B of the pulverizer shaft rotational support assembly and the bushing assembly 160.

The bowl mill 16 in this embodiment is supported on a pair of concrete pillars 162 whereby the gearbox housing of the gearbox support frame 36 is in a suspended or hanging relationship not directly supported from below.

While one embodiment of the invention has been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

We claim:

1. In a bowl mill operative for pulverizing material into smaller particles, the bowl mill having a separator body having a bore, a rotating shaft supported within the bore, a grinding table supported on the shaft for rotation within the separator body, and at least one grinding roll supported within the separator body so as to be operable to exert a grinding force on material disposed on the grinding table for effecting the pulverization thereof, a pulverizer shaft rotational support assembly comprising:

a first rolling element sub-assembly including a first inner race secured to the shaft at a first shaft location, a first outer race and at least one intermediate moving element retained relative to the first inner and outer races for rolling movement of the intermediate moving element relative to the first inner and outer races;

means for radially limiting the first outer race while permitting relative axial movement between the first outer race and the intermediate moving element, the radially limiting means limiting the maximum radial displacement of the first outer race to thereby maintain an annular clearance between the shaft and the bore while permitting axial movement of the first outer race and the intermediate moving element relative to one another in correspondence with axial movement of the inner race, whereby the shaft can freely rotate out of contact with the bore at the first shaft location throughout the range of axial movement of the shaft during axial loading thereof;

a second rolling element sub-assembly including a second inner race secured to the shaft at a second shaft location axially spaced from the first shaft location, a second outer race and at least one intermediate moving element retained relative to the second inner and outer races for rolling movement of the intermediate moving element relative to the second inner and outer races; and means for radially limiting the second outer race while permitting relative axial movement between the second outer race and the intermediate moving element, the radially limiting means limiting the maximum radial displacement of the second outer race to thereby maintain an annular clearance between the shaft and the bore while permitting axial movement of the second outer race and the intermediate moving element relative to one another in correspondence with axial movement of the second inner race, whereby the shaft can freely rotate out of contact with the bore at the second shaft location throughout the range of axial movement of the shaft during axial loading thereof.

2. In a bowl mill operative for pulverizing material into smaller particles, the pulverizer shaft rotational support assembly as claimed in 1 and further comprising a first upper securement member secured to the shaft and a first lower securement member secured to the shaft, the inner race of the first rolling element sub-assembly being disposed axially intermediate the first upper securement member and the first lower securement member to be retained thereby at the first shaft location.

3. In a bowl mill operative for pulverizing material into smaller particles, the pulverizer shaft rotational support assembly as claimed in 2 wherein the first upper securement member is a snap ring.

4. In a bowl mill operative for pulverizing material into smaller particles, the pulverizer shaft rotational support assembly as claimed in 2 wherein the first lower securement member includes a lock nut and a lock washer.

5. In a bowl mill operative for pulverizing material into smaller particles, the pulverizer shaft rotational support assembly as claimed in 2 wherein the first upper securement member is a snap ring and the first lower securement member includes a lock nut and a lock washer.

6. In a bowl mill operative for pulverizing material into smaller particles, the pulverizer shaft rotational support assembly as claimed in 1 and further comprising a second upper securement member secured to the shaft and a second lower securement member secured to the shaft, the second rolling element being disposed axially intermediate the second upper securement member and the second lower securement member and being retained thereby at the second shaft location.

7. In a bowl mill operative for pulverizing material into smaller particles, the pulverizer shaft rotational support assembly as claimed in 6 wherein the second upper securement member is a snap ring.

8. In a bowl mill operative for pulverizing material into smaller particles, the pulverizer shaft rotational support assembly as claimed in 6 wherein the second lower securement member includes a lock nut and a lock washer.

9. In a bowl mill operative for pulverizing material into smaller particles, the pulverizer shaft rotational support assembly as claimed in 6 wherein the second upper securement member is a snap ring and the second lower securement member includes a lock nut and a lock washer.

10. In a bowl mill operative for pulverizing material into smaller particles, the pulverizer shaft rotational support assembly as claimed in 1 wherein the pulverizer includes a gear secured to the shaft and a motive means for driving rotation of the shaft via rotation of the gear about a plane of rotation and the first shaft location at which is located the inner race of the first rolling element sub-assembly is axially above the gear and the second shaft location at which is located the inner race of the second rolling element sub-assembly is axially below the gear.

11. In a bowl mill operative for pulverizing material into smaller particles, the pulverizer shaft rotational support assembly as claimed in 10 wherein the second shaft location is located in the range of about 20% to 80% of the extent of the shaft extending above the gear as measured from the plane of rotation of the gear to the lowermost point of the surface of the grinding table.

12. In a bowl mill operative for pulverizing material into smaller particles, the pulverizer shaft rotational support assembly as claimed in 10 wherein the first shaft location is located in the range of about 20% to 80% of the extent of the shaft extending below the gear as measured from the plane of rotation of the gear to the bottom of the shaft.

13. In a bowl mill operative for pulverizing material into smaller particles, the pulverizer shaft rotational support assembly as claimed in 1 and further comprising a bushing assembly for supporting the shaft for axial movement relative thereto at a third shaft location axially spaced from the first and second shaft locations.

14. In a bowl mill operative for pulverizing material into smaller particles, the pulverizer shaft rotational support assembly as claimed in 1 and further comprising a thrust bearing assembly engageable by the shaft to transmit axial loading forces on the grinding table to the thrust bearing assembly.

15. In a bowl mill operative for pulverizing material into smaller particles, the pulverizer shaft rotational support assembly as claimed in 1 wherein the at least one intermediate moving element of the first rolling element sub-assembly is a bearing.

16. In a bowl mill operative for pulverizing material into smaller particles, the pulverizer shaft rotational support assembly as claimed in 1 wherein the at least one intermediate moving element of the first rolling element sub-assembly is a cylindrical bearing.

17. In a bowl mill operative for pulverizing material into smaller particles, the bowl mill having a separator body having a bore, a rotating shaft supported within the bore, a grinding table supported on the shaft for rotation within the separator body, and at least one grinding roll supported within the separator body so as to be operable to exert a grinding force on material disposed on the grinding table for effecting the pulverization thereof, a pulverizer shaft rotational support assembly comprising:

rolling element means including an inner race secured to the shaft at a first shaft location, an outer race and at least one intermediate moving element retained relative to the inner and outer races for rolling movement of the intermediate moving element relative to the inner and outer races;

means for radially limiting the outer race while permitting axial movement thereof, the radially limiting means limiting the maximum radial displacement of the outer race to thereby maintain an annular clearance between the shaft and the bore while permitting axial following movement of the outer race in correspondence with axial movement of the inner race, whereby the shaft can freely rotate out of contact with the bore throughout the range of axial movement of the shaft during axial loading thereof; and a bushing assembly for supporting the shaft for axial movement relative thereto at a second shaft location axially spaced from the first shaft location.

* * * * *